United States Patent [19]

Burke

[11] 4,277,726

[45] Jul. 7, 1981

[54] SOLID-STATE BALLAST FOR RAPID-START TYPE FLUORESCENT LAMPS

[75] Inventor: Robert V. Burke, Ft. Wayne, Ind.

[73] Assignee: Litton Systems, Inc., Beverly Hills, Calif.

[21] Appl. No.: 937,119

[22] Filed: Aug. 28, 1978

[51] Int. Cl.[3] ..... H05B 39/00; H05B 41/14

[52] U.S. Cl. ..... 315/98; 315/DIG. 5; 315/DIG. 7; 315/201; 315/205; 315/307; 315/101; 331/114

[58] Field of Search ..... 315/97, 98, 102, 105, 315/DIG. 5, DIG. 7, 201, 208, 223, 219, 307, 306, 101, 103, 205; 331/114, 117

[56] References Cited

U.S. PATENT DOCUMENTS

| | | | |
|---|---|---|---|
| 2,923,856 | 2/1960 | Greene et al. | 315/DIG. 7 |
| 3,005,130 | | Schwartz | 315/206 |
| 3,611,021 | 10/1971 | Wallace | 315/307 X |
| 3,973,165 | 8/1976 | Hester | 315/105 |

*Primary Examiner*—Saxfield Chatmon, Jr.
*Attorney, Agent, or Firm*—Robert A. Seldon

[57] ABSTRACT

A novel transistorized fluorescent lamp ballast and lamp combination operates from AC line voltage. The ballast provides for "soft-start" lamp operation in one featured aspect and provides for some lamp light output regulation in another featured aspect thereof.

21 Claims, 1 Drawing Figure

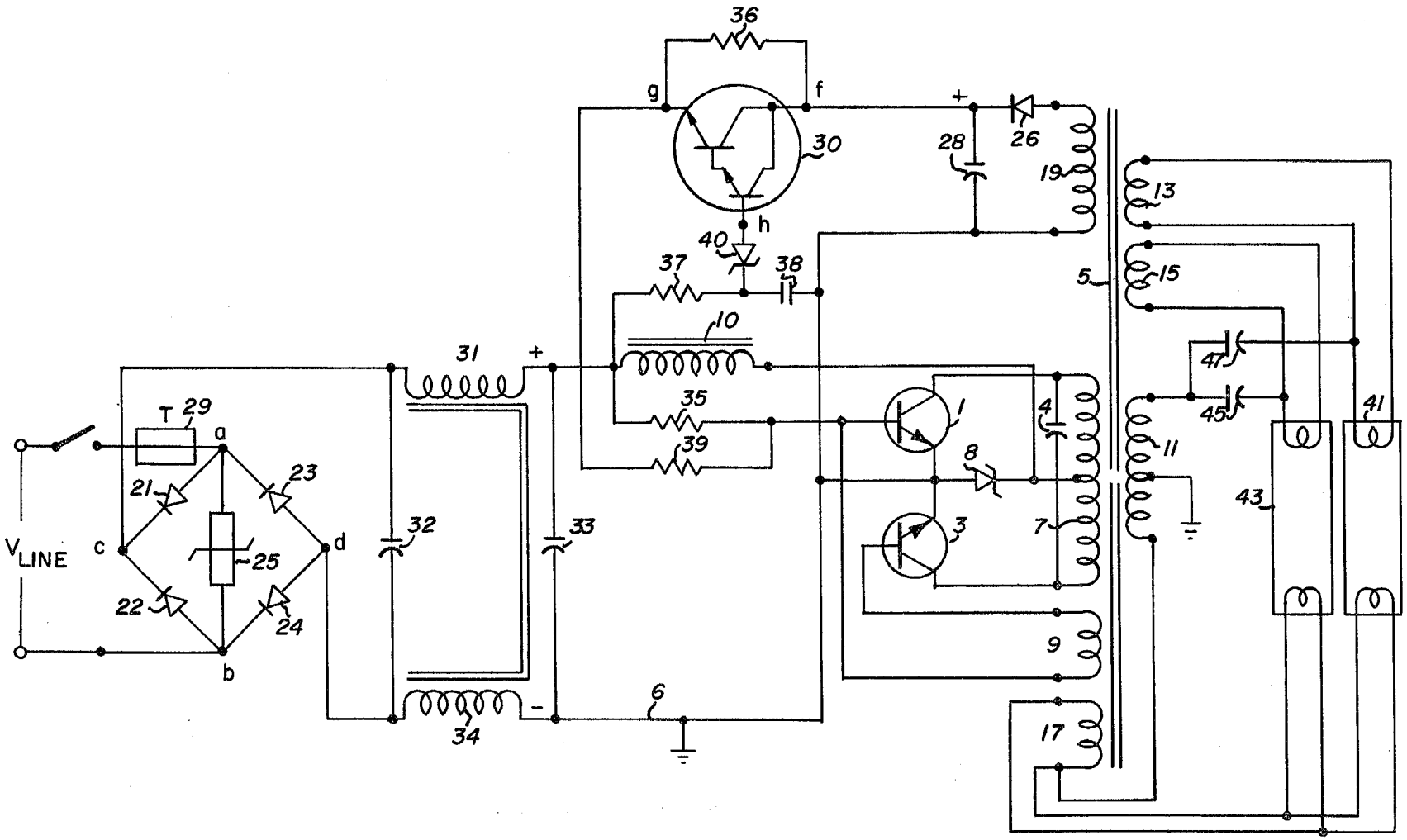
V LINE
T
a
b
c
d
f
g
h
+
-

SOLID-STATE BALLAST FOR RAPID-START TYPE FLUORESCENT LAMPS

BACKGROUND OF THE INVENTION

My invention relates to electronic illumination systems and, more particularly, to an improved solid-state inverter type ballast for starting and operating rapid-start type fluorescent lamps.

The fluorescent lamp is a known illumination device containing a phosphor coated glass tube confining an ionizable gas and a small amount of mercury, electron emitting cathodes, and having electrical terminals at each end, such that upon application of the proper electrical voltages to the terminals the gas becomes ionized and an electrical arc is established between the cathodes through the phosphor coated glass tube, evidenced by current flowing from the source, and the light radiation created by the arc energizes the phosphor coating which thereby fluoresces, generating diffused light. As is known, the fluorescent lamp is a peculiar type of an electrical load which possesses an electrical characteristic, termed by those in the art a "negative resistance". That is, a given high voltage is required to start the lamp and, once started, a lesser voltage is required to sustain its operation. By way of example, one conventional rapid-start type fluorescent lamp, the General Electric F40-T12 model, requires 280 volts peak for starting and for operation requires only 101 volts RMS and draws a current of 0.425 amps.

In present practice, and for some time, the apparatus used in the great majority of structures to provide these voltages to this kind of an electrical load is one which steps up the line voltages, such as 117 volts AC RMS, to the higher starting voltages and includes in a container a transformer of the high leakage reactance type containing a step-up secondary winding and a capacitive reactance in series to each lamp to provide the high starting voltages and, once the lamp starts, to limit current to "ballast" the lamp. Typically, each such lamp ballast contains the means to provide the operating voltage and current for at least two fluorescent lamps. The skilled reader recalls that there are at least two types of fluorescent lamps commonly found in existing lamp fixtures. One type is known as the "instant-start" lamp and the other type is known as the "rapid-start" type lamp. The former contains a special electron emitting cathode which emits electrons under the influence of the high voltage applied across the lamp terminals without the necessity of preheating the cathodes. However, in the latter type lamp the cathodes are of a less sophisticated construction; the lamp includes heaters or filaments through which electrical current is passed to generate heat and thereby warm up or heat the cathodes before the cathodes become sufficiently emissive. Prior practice with electromagnetic type ballast employed starter circuits providing the required short delay between the time heater current is supplied and the application of the high starting voltage across the lamp in order to ensure adequate lamp operating lifetime.

The present invention is particularly concerned with a solid-state ballast for fluorescent lamps of the rapid-start type and to the combination thereby formed. By solid-state ballast I refer to that class of devices which incorporate semi-conductor devices, such as transistors, and additional electrical components in circuits usually of the inverter-oscillator type, by means of which a low AC or DC voltage is transformed to the high-voltage levels required to operate one or more fluorescent lamps.

By way of example of these kinds of ballast, the prior art patent to Greene, U.S. Pat. No. 2,923,856, discloses a solid-state ballast incorporated within a container adapted to serve as a replacement directly for a comparable electromagnetic type transformer ballast. The Greene ballast includes an AC to DC rectifier for converting the line voltage, for example 117 volts AC RMS, to a lower level DC voltage normally specified for transistors, and transistors arranged in an oscillator circuit which in conjunction with a transformer is used to transform the AC currents developed in the transformer's primary by the action of the transistors up to the higher voltages which appear across the transformer's secondary to power the fluorescent lamps. Other types of solid-state ballast circuits appear in Schwartz, U.S. Pat. No. 3,005,130, and others. Specifically, there has been made known to me a particular inverter-oscillator circuit for use in supplying electrical loads in connection with a magnetron microwave energy generating source, as well as in connection with a fluorescent lamp which appears in the patent to Hester, U.S. Pat. No. 3,973,165, granted Aug. 3, 1976. Hester discloses an inverter-oscillator arrangement in which the 117 volt AC RMS is rectified by a bridge rectifier, smoothed by a filter circuit, and the derived DC voltage and current is applied through an inductor into the center tap of a transformer primary winding. Two transistors are arranged in a self-oscillatory circuit, including a parallel resonant circuit in the transformer's primary winding, to alternately conduct current in different directions through opposite halves of the transformer's primary winding for creating the alternating magnetic fields in the transformer's ferrite core, which, in turn, induces a high-voltage high-frequency voltage across a secondary winding for application across the electrical load, such as a capacitor in series with a fluorescent lamp of the instant-start type. An AC feed-back winding on the transformer is connected between the bases of the two transistors and as an additional low voltage secondary winding on the transformer provides AC which is rectified and filtered and applied as a DC bias to the bases of the transistors. The inherent current leakage associated with germanium-type transistors in Hester is used to start the circuit in oscillation as a known alternative to the inclusion of an additional resistor component connecting the transistor's bases directly to the input DC source via a high resistance path of the type found in other prior inverter-oscillator ballast devices. The Hester circuit includes ferrite transformer core containing a small air gap in the magnetic circuit to set the secondary inductance and thereby establish the desired operating frequency underload and assist to ensure a sinusoidal type secondary voltage waveform. Although the Hester circuit disclosed is particularly suited for use with instant-start type fluorescent lamps, those of ordinary skill recognize that the transformer may be modified without invention to include a plurality of conventional low-voltage secondary windings suited for connection to the heaters of rapid-start type fluorescent lamps in a conventional circuit. Ideally, rapid-start type lamps should not be started before the lamp's cathodes have been raised in temperature to a proper level recommended by the lamp manufacturer indirectly in terms of heater current stabilization. If a high enough starting voltage is applied across the lamp, however, simultaneously with the application of the heater voltage, electrical stresses are created on the lamp's cathodes which may commence to emit some electrons and start lamp operation before the cathodes have been fully raised to the temperature desired or as specified by the lamp manufacturer in terms of heater current stabilization, which stabilization I find typically requires a period of about at least 0.3 seconds over which the heater current drops from 3 amps to less than 1 amp for a F40 -T12 type rapid-start lamp, and this mode of operation appears to have been followed in connection with solid-state ballast circuits described in the patent literature. Although the previously described mode of operation does provide an illumination system, the effect is to reduce the operational lifetime of the rapid-start type lamp. Conceivably, a solution to reduced operating lifetime in such a mode is to provide lamps with more rugged cathode structures, which I understand to be available. To do so, however, requires a substantial price premium to be paid for the lamp.

Another consideration in fluorescent illumination systems is for the fluorescent lamps to provide a relatively constant light output during use. It is extremely annoying to users when the light output fluctuates noticeably and for no apparent reason. Those skilled in the art recognize that a cause of such fluctuation is fluctuation in the AC line voltage level, provided by the utility company, which supplies electrical power, indirectly, to the lamps. Solid-state ballasts which derive power from the AC lines are beset with those same variables.

A principal purpose of my invention therefore is to provide an improved solid-state ballast for use in connection with rapid-start type fluorescent lamps, which avoids application of a high starting voltage to the lamps until expiration of a desired cathode heating interval while providing cathode heating current. An ancillary object of my invention is to provide a solid-state AC ballast for starting and operating rapid-start type lamps that does not abruptly apply high starting voltage to the lamp so as to increase lamp operational life. A further purpose of the invention is to provide an AC solid-state ballast and lamp combination having some degree of regulation of lamp current as against line voltage variation. A more specific purpose is to improve upon the two transistor push-pull inverter-oscillator type ballast of the kind referred to in Hester patent U.S. Pat. No. 3,973,165 for providing better overall performance as part of a rapid-start type fluorescent lamp system.

SUMMARY OF THE INVENTION

Briefly, the improved solid-state lamp ballast of my invention includes in a combination of the type containing an inverter-oscillator means, having transistor means and a transformer, for converting DC electrical currents to a high-frequency high AC voltage for application across the terminals of a rapid-start type fluorescent lamp and also to supply high frequency low-voltage AC to the lamp heaters, and power supply means, including an AC to DC rectifier means for converting line AC to DC electrical energy for said inverter-oscillator circuit, the improvement in combination therewith comprising control means responsive to application of voltages from said power supply means to said inverter-oscillator means for providing base drive current to said transistor means of less than a first predetermined current level for a first time interval and for increasing in level said base drive current subsequent to the lapse of said first interval gradually from said first level to a second higher current level over a second time interval so that the AC voltage across said lamp increases to lamp starting voltage level only after the lapse of a first time interval and, more particularly, does so between the end of the first and end of the second time interval. In a more specific aspect of my invention, said control means includes at least two transistors arranged in a Darlington circuit, a supplemental transformer winding for supplying low-voltage high-frequency AC, and rectifying and filtering means coupled to said winding for providing DC to the collector of said Darlington transistor means, and means connecting said Darlington transistor means in electrical series circuit with the base of the transistor means in the inverter-oscillator circuit for controlling base drive current. In a further aspect of the invention, timing network means, including a resistance and a capacitance in series, is connected to said power source and to a control electrode in said Darlington circuit. In a still further aspect of the invention, resistance means is provided across said Darlington transistors to provide a limited DC current to said transistor base irrespective of the operational current-conducting condition of said Darlington transistors.

The foregoing and other objects and advantages of my invention, together with the structure characteristic thereof and equivalents thereto, becomes more apparent to the reader through review of the detailed description of a preferred embodiment of my invention considered in connection with the FIGURE of the drawing illustrative thereof.

DESCRIPTION OF THE PREFERRED EMBODIMENTS

Reference is made to the embodiment of the invention depicted in the drawing which includes a first NPN type transistor 1, a second NPN type transistor 3 and a transformer 5. The transformer contains a center tapped primary winding 7, a low voltage feedback winding 9, a center tapped high voltage secondary winding 11, low voltage secondary windings 13, 15 and 17, and an additional low voltage winding 19, with all of the windings located on the gapped magnetic ferrite core as represented by the two parallel lines. The collector of transistor 1 is connected in circuit with one end of, and the collector of transistor 3 is connected to the other end of, primary 7. A capacitor 4 is connected across the primary to form therewith an L-C parallel resonant circuit. For purposes of this description, lead wire 6 is the circuit neutral or common reference point. Wire 6 is connected to the emitters of transistor 1 and 3 and a Zener diode 8 is connected between the emitters and the center tap of primary 7, the diode being poled with its cathode connected to the primary center tap. An inductor 10, described in greater detail hereinafter, has one end connected to the center tap of primary winding 7 so as to place the inductor in series circuit therewith. Alternate ends of feedback winding 9 are connected to the respective bases of transistors 1 and 3, as illustrated. The foregoing circuit arrangement in general is that of the push-pull type inverter-oscillator described in the background to this detailed description. To the left hand side of the figure, terminals are provided for application of a source of 120-volts AC to the input arms a and b of a conventional bridge rectifier, consisting of the four rectifier diodes 21, 22, 23 and 24, and the bridge rectifier and other circuit components are protected by a varistor 25 connected across the input arms of the bridge. A resettable thermal circuit breaker 29 is connected electrically in series with one lead and electrical "on-off" lighting switch to the 120-volt AC line source, illustrated for completeness, and the first input arm of the bridge rectifier and the remaining source lead is connected directly to the bridge's other input arm. One output arm of the bridge rectifier d is connected in series with a choke inductor 34 to neutral wire 6 and the other output arm c is connected to one end of an inductor 31. Capacitor 32 is connected between one end of inductors 31 and 34 and capacitor 33, of larger value than capacitor 32, is connected between the output ends of chokes 31 and 34. The output end of inductor 31 is connected to the input end of inductor 10, previously identified, placing it in series circuit therewith.

Inductor 34 has approximately the same inductance value as of inductor 31. As is represented by the U-shaped lines representing an iron core, both of inductors 31 and 34 are formed on the same core of iron material, such as by mounting side by side or bifilar wound, for economy of construction, a practice possible because the current which passes through the respective windings in operation flow in opposite directions.

As is apparent, the bridge rectifier and "$\pi$" filter formed with elements 31, 32 and 33, provide the partially filtered DC voltages and currents from a 120-volt AC RMS input and is specifically adapted for the disclosed embodiment.

A high value resistor 35 is connected in series between the output end of inductor 31 and the parallel circuit to the base of transistor 1 and through secondary winding 9 to the base of transistor 3.

Low voltage secondary winding 19 is connected in series with a diode 26 and a filter capacitor 28 with the cathode end of the diode connected to the side of the capacitor indicated as of positive polarity "+" and one end of the capacitor and the winding are connected in common to neutral point 6.

A conventional Darlington transistor device 30 contains two transistors, each of the NPN type, in which the transistor's collectors are electrically placed in common, and the emitter of a first transistor is connected to the base of the second transistor and the emitter of the second transistor serves as an output, as illustrated in the schematic symbol. The Darlington's collector f is connected to the "+" end of capacitor 28 and its emitter g is connected in series circuit with a low resistance 39 to the base of transistor 1 and through the path through winding 9 to the base of transistor 3. A medium value resistor 36 is connected between the emitter and collector terminals of Darlington 30 to provide a shunt resistance path across the Darlington circuit to resistor 39. A resistor 37 and a capacitor 38 are connected in series circuit between the output end of inductor 31 and circuit neutral 6 and forms an R-C type timing network. A diode 40 of the Zener type is connected between the juncture of elements 37 and 38 to the base h or control input, as variously termed, of Darlington transistor 30. Turning to the right hand side of the figure, low voltage secondary winding 13 is connected across the heater terminals of a first fluorescent lamp 41 and the low voltage secondary winding 15 is connected across the heater terminals of the second fluorescent lamp 43. Low voltage secondary winding 17 is connected across each of the remaining heater terminals of lamps 41 and 43 in parallel circuit. As illustrated, the center tap on the high voltage secondary winding 11 is connected to a circuit ground for protective purposes and one end of secondary winding 11 is connected in series with a series load capacitor 45 to a heater terminal end of lamp 43. A second capacitor 47 and lamp connection is made in parallel with the foregoing between one winding end of winding 11 and the corresponding heater cathode terminal of lamp 41. The remaining end of secondary 11 is connected in common with a lead from low voltage winding 17 and, as appears in the circuit, is applied to the remaining cathodes of each of the lamps to place each of the series combinations of capacitor and lamp across the secondary.

The invention described is made by the mechanical assembly of known component elements as are available and other components manufactured in known ways to the requirements as described in this specification, known to those skilled in the art. The electrical connections, defined by lines in the drawings, with which to connect the elements electrically together in the circuit, may be insulated electrical wire or, preferably, electrical conductors formed on conventional printed circuit board. The electrical connections are made by direct contact between the component leads and the wires with or without the use of electrical solder, the latter preferred, as is known to those skilled in the art, and with or without the use of standard electrical sockets, plugs and connectors, the details of which are known and form no part of the improved combination invention.

Obviously, the values of the component elements in my combination may be modified to suit the particular requirements of the designer in the practice of the invention described. It is believed that the following component values of a specific embodiment of my invention ensures that the invention is described to a greater degree than is required by law. Thus, rectifier diodes 21 through 24 are rated at 1 amp; capacitor 32 is 3 $\mu$f; C33, 35 $\mu$f; C38, 0.68 $\mu$f; C28, 25 $\mu$f; C4, 0.01 $\mu$f; C47, 0.0062 $\mu$f; C45, 0.0062 $\mu$f; inductor 31, 100 MH; conductor 34, 100 $\mu$H; inductor 10, 7 MH; diode 40, 20 volts; diode 8, 285 volts; diode 26, 1 amp; resistor 35, 120 K$\Omega$; resistor 39, 120 $\Omega$; resistor 36, 1.5 K$\Omega$; resistor 37, 3.3 M$\Omega$; transistors 1 and 3, 3 amps; Darlington 30, 400 mils; primary winding 7, 90 turns; winding 19, 2 turns; windings 13, 15, 17 and 9, 1 turn each; winding 11, 100 turns; transformer 5 core, 1.3×1.6 inches, with core gapped approximately 0.04 inches underlying the secondary winding; lamps 41 and 43 each GE Model F40-T12.

In the operation of this ballast, operating the user's light switch S connects AC line voltage, such as 120-volt AC 50 or 60 Hertz, to the bridge rectifier, consisting of the diodes 21 through 24, with current flowing thereinto through the thermal circuit breaker 29 with the output appearing as a full wave pulsating DC voltage across the "+" and "−" output arms of the bridge rectifier. This rectified voltage is fed into the $\pi$ filter, consisting of the inductor 31 and capacitors 32 and 33, and the filter partially "smooths" or filters the pulsating DC to provide a DC voltage with moderate ripple content. This serves as a DC power source in this ballast combination, as is understood by those skilled in the art, and provides partially filtered DC voltage even under "load" conditions in which current is drawn. As is conventional, DC current flows out from the "+" side of the source to the circuits and back therefrom through the neutral 6. Inductor 31 and inductor 34 have additional functions of presenting a high electrical impedance to high frequency energy, that substantially above the 50 or 60 Hertz line frequency, or transients generated in the circuitry to prevent same from reaching the bridge rectifier or the AC line and in assisting to optimize input power factor. Suitably, a small amount of DC current flows from the "+" side of the DC source through high value resistor 35 to the base of transistor 1 and 3. This current is sufficient to provide minimal base drive current required by transistors 1 and 3 and start the transistors in an oscillatory mode in which the transistors conduct current alternately through the respective halves of primary winding 7 under all possible ambient temperatures in which the ballast may be used. Other known means of starting oscillation may be substituted where desired for specific operating conditions. With one transistor started, DC current then flows through inductor 10 into the primary winding center tap, and, assuming transistor 1 to be biased to conduct current, or "on", through the primary winding half and the transistor's collector to emitter, to the neutral wire 6 and back to the negative power source terminal creating a corresponding magnetic flux in the transformer core and inducing a voltage in the other windings. With transistor 3 in the current-conducting condition and transistor 1 nonconducting, current flows through inductor 10, the primary center tap, the remaining half of the winding, the transistor collector to emitter via neutral 6, again back to the power supply, creating a corresponding magnetic flux in the transformer core opposite in polarity direction, since the current through this other primary winding half is in the opposite direction. Inasmuch as the current through the primary winding reverses in direction, the alternating action creates a changing magnetic field in the transformer core and, through magnetic action, an AC voltage is developed across each of the secondary windings 11, 13, 15, 9, 17 and 19.

The polarity of the voltage applied by the feedback winding to the base of one transistor is 180 degrees out of phase with that applied to the base of the other transistor, because the respective bases are connected to opposite ends of the secondary winding 9. This feedback voltage is such as to bias one transistor into the current-conducting or "on" state and the other biased "off". When primary current reverses direction the voltage across feedback secondary 9 also reverses so as to bias the other transistor "on" on the first transistor "off". The rate or frequency at which the transistors 1 and 3 alternately switch on and off in self-sustained oscillation by reason of the voltage feedback is the frequency of the oscillator and is governed by the natural electrical characteristics of the circuit, as described in greater detail in Rodden, *Transistor Inverters and Converters,* Wireless World, 1963, D. Van Nostrand Co. Essentially the electrical characteristics of inductance, capacitance and resistance presented to the transistor circuit at the primary winding by the electrical load, including the effective inductance of the transformer as reflected to the primary, the electrical loads and capacitor 4, define an parallel resonant L-C circuit and the circuit switches at or generates high frequency oscillation essentially at that resonant frequency. In this inverter circuit the inductance of inductor 10 is large in value with respect to the self inductance of primary winding 7. By that I mean the ratio of inductance between the two being in the range of 2.5 to one at a minimum and ten to one to as much as one-hundred to one as a maximum. This relationship assures that the current into the primary winding is essentially a constant current.

In the foregoing manner, the low AC voltage appearing across secondary 19 generated through the transformer action is half-wave rectified by rectifier 26 to charge capacitor 28 arranged in a half-wave rectifier-filter circuit so that a DC voltage is built up across 28 with the positive polarity indicated. Current from this DC source flows initially through medium value resistor 36 and low value resistor 39 to the base of transistors 1 and 3 to furnish additional operating base drive current thereto, supplementing the very small bias current supplied via resistor 35 as previously described. By supplying drive current in this way instead of directly from the bridge rectifier, the $I^2R$ losses are less and the overall electrical efficiency of the unit is enhanced.

It is noted that once the fluorescent lamps are operating as subsequently described in this specification, they change from essentially a "no-load" capacitance to an effective resistance in the secondary circuit, and this effect is "reflected back" to the primary as a dissipative load in the aforementioned resonant circuit, to establish new circuit conditions resulting in a new frequency of resonance for the inverter-oscillator.

It is noted that in addition to its function as a resonant circuit element, capacitor 4 serves to absorb any high frequency energy that may be developed as a result of an electrical nonlinearity in the electrical load, that might otherwise be coupled back into the primary winding by means of primary to secondary winding leakage inductance in transformer 5, as well as to smooth somewhat any transients as may be presented via inductor 10 to that circuit location. Zener diode 8 is a known component which conducts current in one direction as a conventional diode from its anode to its cathode, and blocks current in the reverse direction until the level of reverse voltage exceeds the diode's characteristic reverse breakdown voltage level and thereupon the diode conducts current in the reverse direction. In this embodiment, the Zener diode is electrically poled so as to be normally nonconducting and to conduct current in the reverse direction only upon occurrence of a sufficiently large voltage transient appearing thereacross. This thus prevents such transients from reaching the transistors.

The AC voltage developed across the secondary windings, particularly high voltage secondary winding 11, depends in part upon the voltage across the primary winding 7 as well as the winding turns ratio, N, the ratio between the number of turns of wire forming the secondary winding to the number of turns in the primary. By furnishing only a limited base drive current through resistor 36 to the inverter transistors, the voltage across the primary and the current which flows therethrough is necessarily limited and that limitation in turn creates smaller magnetic fields and hence a smaller voltage across secondary 11 as compared to that produced when transistors 1 and 3 are driven into their full current conducting condition, saturation, as is contemplated in the prior art inverters such as that described in Hester, U.S. Pat. No. 3,973,165, and hereafter in this circuit operation. Inasmuch as the AC voltages across windings 13, 15 and 17 are very low in any event, such as 4 volts, the effect of this restriction to the purpose of those windings is not significant and current at such low voltage is furnished by each of such heater windings to the associated lamp heaters. However, the voltage applied across each of the series load circuits, consisting of each of capacitor 45 and lamp 43 and capacitor 47 and lamp 41, is such that the voltage produced across secondary 11 during the interval is less than the required starting voltage for these lamps. This may be approximately 20 percent less than the starting voltage. Hence, the lower peak AC voltage across winding 11, a peak voltage below lamp starting voltage, is significant in this part of the circuit in that the lamps cannot be started while the lamp cathodes are being heated.

Returning again to the +DC output at the right end of inductor 31 as illustrated in the figure, at the time that the 120-volt AC is applied to the circuit and rectified, DC current flows through the series circuit consisting of resistor 37 and capacitor 38, the timing network. As is understood by those skilled in the art, a series R-C circuit has the characteristic which with a given DC voltage applied thereacross, current will flow through the resistor to gradually charge the capacitor over a period of time evidenced by a building up of the voltage on the capacitor, eventually equalling the voltage level of the source. This voltage buildup across the capacitor is logarithmic with time as is known, and the time required for the voltage across the capacitor to equal approximately 63 percent of the voltage level of the applied DC source is equal to (1/RC) seconds, where R is the resistance value expressed in ohms and C is the capacitance value expressed in farads. However, because the voltage appearing at the end of inductor 31 is not a constant but includes some ripple, as previously described, the exact time constant for this circuit is best empirically determined, although it is approximately equal to the value determined mathematically from the expression stated.

After an interval subsequent to the application of voltage to the ballast, the voltage across capacitor 38 attains a first predetermined voltage level, approximately 20 volts, which I regard as a "trigger voltage level" for Zener diode 40 in a specific embodiment and occurring after the lapse of approximately 0.15 seconds from the time that the 120-volts AC is applied to the ballast input. Concurrently, it is noted that this allows the heater windings to furnish heater current to the lamp cathodes for that time period while the voltage across secondary 11 is insufficient to cause the heater lamp to start.

At the lapse of the time interval, the voltage across capacitor 38 attains the "trigger voltage level" causing Zener diode 40 to "break down" or switch into the current condition and conducts DC current in the reverse direction into the control input, base h, of Darlington 30. In turn, Darlington 30 commences to conduct current through its collector and emitter from capacitor 28 of the supplemental DC source. This additional current flows in shunt of resistor 36 and flows via resistor 39 into the base of switching transistors 1 and 3.

In considering the mode of operation previously described, with a greater base drive current each switching transistor conducts a greater amount of current on each half cycle of high frequency AC in the oscillatory mode of operation earlier described, creating more current in the transformer's primary winding, a greater magnetic field in the magnetic core, and ultimately induces a greater voltage than before at each of the transformer's secondary output windings, including high voltage secondary 11. Returning again to capacitor 38, it is recognized that continued charging of the capacitor continues to increase the voltage thereacross above the threshold voltage level previously described and likewise Darlington transistor 30 supplied with greater base drive at base h becomes more fully conductive in its emitter to collector circuit and thus furnishes greater base drive current into the base of switching transistors 1 and 3. This increase continues until such time as transistor 30 attains current saturation, which effectively places a maximum limitation on the base drive current furnished through the Darlington to the base of transistors 1 and 3.

As described, the high-voltage high-frequency AC originally appearing across winding 11 was of a first level, one less than the lamp starting voltage. The voltage across high-voltage secondary winding 11 gradually increases to a level up to the lamp starting voltage level required for one of the lamps. Lamp current commences gradually and then fully to provide the desired illumination.

Because no two fluorescent lamps are exactly identical in structure, one of the lamps generally will require a lower voltage to start than the other in the two-lamp system illustrated, and one starts a short time before the other, approximately a tenth of a second.

In my combination, the Darlington transistors thus provide a first function of an electronic switch which after the lapse of a predetermined interval is switched from a nonconducting to a current-conducting condition and provides an increase in base drive current to the switching transistors 3 in the inverter-oscillator portion of the circuit commencing from a first level primarily established by resistor 36. Thereafter, over a succeeding interval of time, the Darlington serves as a control amplifier gradually increasing that base current drive level to a second greater level.

Prior to starting, each lamp functionally appears in this system as a small capacitance. However, once started, the lamp draws large current and dissipates energy with the series capacitance serving to restrict current in the circuit. As a result, the resonant frequency of the inverter-oscillator shifts to a lower frequency under the higher current load. Because the Darlington circuit continues to increase base drive current, the secondary voltage increases further until the second lamp is started and this, in turn, once started, draws further current through secondary 11 and results in lowering the rate or frequency of the oscillator still further. I regard this mode of operation as a "soft start" in the sense either that both lamps are not started simultaneously which would create a large current surge in the secondary circuit that might generate harmful transients and, secondly, that because the output voltage is "building up" gradually to the starting level the starting current is more gradual than otherwise. In my opinion, this latter result materially avoids stresses on the lamp's cathodes and should enhance lamp life.

Another aspect of my invention is obtained by utilizing the variation in the storage time of the inverter switching transistors, transistors 1 and 3, as a function of base drive current to provide some regulation of lamp current against line voltage variation of the 120-volt AC line input. For this function, an optimal characteristic desired in a switching transistor is a fast "rise" and "fall" time and a long storage time. That is, long in the sense that if the storage time of the transistor is substantially less than the pulse width at the inverter's switching frequency by at least 1 to 100 or lesser ratio, then essentially no significant variation in storage time occurs due to the change in base drive current. By selecting switching transistors that have a storage time characteristic within an order of magnitude of the inverter's switching time, such as on the order of 10 to 20 to 1 ratio, an effective variation in storage time with base drive current is obtained. For example, if the inverter is designed to switch at a frequency of 25 kilohertz during lamp operation, equivalent to a 20 microsecond pulse width, the storage time of the transistor selected is on the order of 1.25 to 2.5 microseconds in order to take advantage of this function.

Considering transistors 1 and 3 in the illustrated embodiment to be of the type having a long storage time that varies in essentially a direct proportion to the base drive current over a range of base currents, it is appreciated that as the base drive current is decreased the storage time decreases, and vice versa. The effect of a percentage drop in the AC line voltage at the ballast input from the 120-volt AC level by 10 percent, by way of example, results in a lowering of the DC voltage at the output of $\pi$ filter inductor 31 and reduces the drive current through inductance 10 into the primary 7 in the operation of the inverter-oscillator section. That, in turn, produces a drop in the voltage across primary 7. Inasmuch as the primary voltage decreases, the voltage across each of the secondary windings, including the high voltage secondary 11 and supplemental winding 19, which is related to the primary voltage by essentially the turns-ratio between the windings, also decreases essentially in a proportional amount. Recalling from the prior description of operation of the Darlington circuit and this ballast, Darlington 30 was in current saturation, conducting maximum current from the rectified voltage at capacitor 28 supplied by secondary winding 19 to the base of switching transistors 1 and 3. The voltage drop across diode 26, the Darlington 30, resistor 39, and the voltage drop between the base and emitter of each of the switching transistors 1 and 3 is constant; hence, as the voltage produced across secondary winding 19 decreases and reduces the DC voltage at capacitor 28, the current from Darlington 30 through resistor 34 and into the base of the transistors 1 and 3 also decreases to a lower level. As a further result of the latter effect, the storage time of switching transistors 1 and 3, functionally dependent upon base drive current, also decreases.

As previously described, the frequency of self-oscillation or rate of switching of the inverter-oscillator depends upon the characteristics of the resonant circuit including the effective capacitor 4, the effective inductance of the transformer, the electrical load as reflected from the secondary into the primary winding 7 as well as other circuit capacitances and resistive or dissipative elements in the circuit. This includes the dissipation and capacitance in the switching transistors. The transistor's capacitance is a function of the transistor's "storage time". That is, with a greater storage time the effective capacitance is larger. As the storage time decreases, this capacitance decreases, as is known. Thus, in this combination, any variation in the storage time of the switching transistors has an effect upon the resonant circuit and, accordingly, the frequency of its self-oscillation.

By reason of the foregoing relationship, the decrease in the AC line voltage indirectly produces a decrease in the storage time of the switching transistors, which in turn causes an increase in the frequency of oscillation in addition to the decrease in voltage across secondary 11 earlier described. The net effect across the secondary winding 11 is a lower secondary AC voltage and a higher frequency of that voltage than before.

It is recalled that lamps 41 and 43 are in the operating condition. Each of lamps 41 and 43 are connected in series circuit with a corresponding capacitor 47 and 45, respectively, and the impedance, Z, of each of these circuits to AC current is a function both of the AC voltage level applied thereacross and the frequency somewhat according to the theoretical expression:

$$I_{lamp} = \frac{E}{\sqrt{R^2 + (1/\omega C)^2}} = E/Z$$

By that expression, as frequency, $\omega$, increases, the impedance Z decreases and lamp current increases for a fixed voltage, E, whereas a decrease in the voltage E, maintaining frequency constant, lamp current decreases. Hence, by downwardly changing the other variable, Z, when the first, E, changes downwardly, one is used to partially offset the other. Thus any change in the AC line voltage provided to the input of the ballast as would lower the lamp current is at least partially offset by the increase in lamp current effected by raising the output frequency of the oscillator in accordance with my invention. In this way, the net percentage decrease in lamp current is not as great as the percentage drop in AC line voltage, and in this respect some regulation of lamp current is obtained, so that the illumination provided is relatively constant.

The converse relationship also hold when the line voltage increases and is restored to its normal level. That is, the AC voltage across secondary winding 11 increases but the frequency of that voltage decreases as a result of increasing the base drive current to the switching transistors to increase the storage time of same. I have found that for a 10 percent drop in line voltage, a less than 10 percent change in lamp operating current results and this is important in the application of the illumination system inasmuch as it tends to maintain the lamp's light output somewhat constant as against variations in the line voltage.

To take advantage of this additional function, the switching transistors ideally should have a fast rise time, a fast fall time and a long storage time. Preferably, each of switching transistors have a storage time within the approximate range of 5 percent to 25 percent of 1/(2f), where f is the oscillation frequency of the oscillator during operation under lamp load, preferably about 10 percent of 1/(2f). By way of example, one type of transistor has a rise, fall and storage time of 0.3 microseconds, 0.4 microseconds and 1.7 microseconds, respectively. Another type has a rise time of 0.7 microseconds, a fall time of 0.9 microseconds, and a storage time of 3.5 microseconds which is suitable for the specific embodiment disclosed.

It is understood, however, that the present invention does not preclude the use of transistors with small storage time as might be desirable for other reasons, even though in the preferred embodiment I choose transistors with a large storage time. Thus, a fast switching transistor with a small storage time which is unable to provide regulation in the foregoing manner, may be desired from the standpoint of lower cost transistor or to provide a slight increase in the electrical efficiency of the solid state ballast, sacrificing some lamp current regulation by that substitution. However in so doing, the resultant circuit and aspect of my invention, by means of which the voltage applied across the lamp during the initial turn-on period is maintained at a lower starting level and gradually increased to provide a soft start voltage, is still accomplished.

In connection with the mode of operating of the timing circuit prior to lamp starting, those skilled in the art recognize that the voltage across capacitor 38 in the R-C timing network, including series connected resistor 37 and capacitor 38, depends upon the level of the applied voltage as well as the time duration of the voltage applied thereacross. Since the voltage across that capacitor is used to determine an elapsed time interval, the interval may vary from a set period if the applied voltage is not held constant. Thus in a specific example, the time of 0.3 seconds is usually sufficient where the lamp filaments are provided with 3.06 volts RMS, in accordance with manufacturer's recommendation.

The applied voltage is obtained by rectification of the AC line voltage as shown in the preferred embodiment. In common experience, AC line voltage may vary in level from time to time during a day. The elapsed time between operating switch S, as defined by the time required to charge capacitor 38 through resistor 37 to the desired trigger voltage level of the selected Zener diode 40, and operating diode 40, may vary from the ideal as a function of line voltage level. However, it is not necessary for this initial time interval to be precisely fixed or held constant in the practice of my invention. Thus in one particular test with the AC line voltage at a level of 105 volts RMS, the initial time delay or elapsed time required to charge capacitor 38 to the trigger voltage level was 0.92 seconds. With the AC line voltage at 110 volts RMS, the initial time interval required for the voltage across capacitor 38 to reach the trigger voltage level was 0.73 seconds; at 120 volts RMS, the time required was 0.5 seconds; and at 132 volts RMS, considered the outer limit for acceptable line voltage variation, the trigger voltage level was reached after 0.4 seconds. It is recognized that other timing circuits may be substituted in the combination to set this initial or first time interval at a constant value or make the time intervals independent of any line voltage variation and the apparatus so modified by such a substitution still comes within the broad scope of the invention. However, it is undesirable from the standpoint of cost and, as a practical matter, the interval may vary between just under 0.3 seconds to 1 second more, as measured from the closure of switch S without being noticeable or inconvenient to the lamp user. The incentive thus to make such a substitution of an equivalent timing circuit, in my opinion, does not exist and the timing network illustrated is preferred.

Further, in a practical embodiment, the filtered DC voltage obtained from the power supply at the "+" side of inductor 31 was 140 volts DC average. This voltage contained a 35 volt "ripple" and the power factor as measured at the input to the bridge rectifier of the operating ballast and lamp combination illustrated was 93 percent.

It is noted that by increasing the size of capacitor 33 in the power supply from a value of 35 $\mu$f to 100 $\mu$f, by way of example, the ripple voltage reduces in level and effects greater "smoothing" of the rectified DC voltage, which is desirable. However, in so doing, the power factor decreased to 90.5 percent. That reduction in power factor is less desirable from an overall practical standpoint and, accordingly, the smaller value of capacitance is preferred.

Applicant cannot compare the results obtained from a specific embodiment of an AC solid-state ballast and fluorescent lamp combination with AC solid-state ballasts made by others since applicant has not obtained any made by others which have been found to be acceptable in commercial practice. Accordingly, comparisons presented are between the present combination and a "standard" electromagnetic type ballast. Briefly, in a practical embodiment of the described combination, using the same lamps and line voltages, the lighting efficiency of a standard ballast was approximately 67 lumens per watt, whereas the illumination efficiency of my combination was 83 lumens per watt. The light output of the combination incorporating my ballast rose to a stable acceptable level within a period of 5 minutes after being switched on and remained relatively constant thereafter. By contrast, the light output using a standard ballast rose to a higher than normal level after turn-on and required approximately one hour to stabilize at the lower acceptable value. Another noteworthy point is the lamp cathodes in the described combination operate at a lower temperature than lamps employed in a standard electromagnetic type ballast construction and, in my opinion, as a result the useful operating life of the lamp is lengthened.

It is believed that the foregoing description of a preferred embodiment of my invention is presented in sufficient detail as will enable one skilled in the art to make and use same without undue experimentation. However, in so doing, it is not my intent to restrict or limit my invention to those details inasmuch as other elements may be substituted and improvements or modifications may be made to the foregoing, all of which embody the invention and become apparent to those skilled in the art upon reading this specification. Accordingly, it is respectfully requested that my invention be broadly construed within the full spirit and scope of the appended claims.

What I claim is:

1. In an inverter-oscillator means for supplying AC voltage and current for starting and operating an electrical load of the type comprising a capacitor and a gaseous discharge lamp of the type requiring a high starting voltage and a lower operating voltage connected in electrical series circuit, whereby current through said circuit is dependent upon the AC voltage across said load and the frequency of said AC voltage, and inverter-oscillator means for generating high frequency AC voltage, including transistor means and transformer means, said transformer means responsive to current from said transistor means for producing an AC voltage proportional in level to said current and applying said voltage to said electrical load, and power supply means for supplying DC voltage and current to said inverter-oscillator means, the improvement comprising in combination therewith:

first means responsive to a change in level of said DC voltage for producing an inverse change in the frequency of oscillation of said inverter-oscillator means.

2. In an inverter-oscillator means for supplying AC voltage and current for starting and operating an electrical load of the type comprising a capacitor and a gaseous discharge lamp of the type requiring a high starting voltage and a lower operating voltage connected in electrical series circuit, whereby current through said circuit is dependent upon the AC voltage across said load and the frequency of said AC voltage, and inverter-oscillator means for generating high frequency AC voltage, including transistor means and transformer means, said transformer means responsive to current from said transistor means for producing an AC voltage proportional in level to said current and applying said voltage to said electrical load, and power supply means for supplying DC voltage and current to said inverter-oscillator means, the improvement comprising in combination therewith:

means responsive to the application of DC voltage from said power supply means for limiting the current conducting capability of said transistor means to a first level for a predetermined interval and thereafter gradually increasing the current conducting capability of said transistor means to a second level over a further interval, whereby the voltage applied to said electrical load is initially restricted to a first low level and thereafter increased gradually to a second higher level sufficient to start the lamp.

3. The combination comprising:

a transformer including a center tapped primary winding, a high voltage secondary winding, a feedback winding, a plurality of heater windings, a supplementary secondary winding with all of said windings mounted to a gapped core of ferrite material;

first and second transistor switching means each containing base, collector and emitter elements;

first inductor means, said inductor means having an inductance level at least two and one-half times and as much as one-hundred times as large as the inductance of said primary winding;

means connecting said first inductor means at one end in series circuit to said center tap of said primary winding;

first capacitance means connected across said primary winding to define therewith a resonant circuit;

each of said first and second transistor switching means being coupled to respective halves of said primary winding to define a current conducting path from said center tap of said winding from a respective alternate end of said primary winding to a circuit common for alternately conducting current through said primary winding halves in opposite direction to create an alternating magnetic field;

means connecting opposite ends of said feedback winding to the base of said first and second transistor means respectively, for providing an AC control voltage to said transistor's bases which are 180 degrees out of phase;

first AC to DC rectifier means adapted to rectify AC line voltage;

first filter means including a filter inductor and a filter capacitor, coupled to said rectifier means, for providing partially filtered DC at an output;

means connecting the output of said filter means in circuit with a remaining end of said first inductor means for providing DC current thereto;

first high resistance means connected between said filter means output and a base of at least one of said transistors for supplying a limited DC current to said transistor base;

a first load capacitor;

a first fluorescent lamp means having a negative resistance characteristic and being of the type requiring a high starting voltage and a lower operating voltage, said lamp means containing first and second cathode heaters;

said first load capacitor and first lamp means being connected in electrical series circuit across said high voltage secondary winding;

lead means connecting a first one of said plurality of heater windings to said first cathode heater;

lead means connecting a second one of said plurality of heater windings to said second cathode heater;

means for connecting said high voltage secondary winding in series circuit with at least one electrical load, said load comprising a capacitor means and a fluorescent lamp means connected in series circuit;

whereby a self-oscillatory circuit is defined which operates at a frequency dependent in part upon said resonant circuit;

second DC voltage source means, including second rectifier and second filter means, said supplementary secondary winding for providing a DC voltage proportional to the current in said transformer primary winding;

second resistance means and third resistance means, said second and third resistance means connected in series circuit to the base of one of said first and second transistor means for providing a limited current from said second DC source to the bases of said first and second transistor means directly and through said feedback winding; sand second resistance means being at least five times larger than said third resistor means;

third and fourth transistor means having the emitter of said third transistor means connected to the base of said fourth and having the collectors connected in circuit together to define a Darlington circuit having the base of said fourth transistor means serving as a control input, and means connecting said fourth transistor means in parallel circuit with said second resistor means for conducting current in shunt thereof responsive to the level of current input to the base of said fourth transistor means to permit additional current to be provided through said third resistance means to said first and second transistor bases; said Darlington circuit for conducting DC current in a level positively functionally dependent upon current provided to said control input up to a maximum saturation current level;

timing circuit means, including a resistor and a capacitor in series circuit; said timing circuit means connected across said first filter means output and said circuit common;

breakdown diode means, said diode means having the characteristic of being nonconductive until the voltage applied thereacross exceeds a trigger voltage level, said diode means connected between said timing circuit means and said base of said fourth transistor means for providing current to said control input of said Darlington circuit after the lapse of an interval of time responsive to the voltage across said capacitor of said timing circuit means exceeding said trigger voltage level;

and wherein each of said first and second transistor means have a storage time characteristic, said storage time being within the approximate range of 5 percent to 25 percent of 1/(2f), where f is the frequency of AC voltage developed by said oscillator means and said storage time characteristic being variable in proportion to base drive current whereby change of storage time changes the condition of said resonant circuit.

4. The combination as defined in claim 3 further comprising:

second load capacitor;

second lamp means, containing first and second cathode heaters and being of the same type as said first lamp means;

said second lamp means and said second load capacitor being connected in series across said high voltage secondary winding;

lead means connecting a third one of said plurality of heater windings to said first cathode heater of said second lamp;

and means connecting said second one of said heater windings to said second cathode heater of said second lamp means.

5. The invention as defined in claim 3 wherein said AC to DC rectifier means comprises a bridge rectifier and wherein said filter means partially filters said rectified DC.

6. Electronic apparatus for providing starting and operating voltages to a pair of rapid start type fluorescent lamps of the type including a transformer of a gapped ferrite nonsaturating core type containing a center tapped primary winding, a plurality of heater windings, a high voltage secondary winding, and a feedback winding, said heater windings having a step-down voltage relationship to said primary winding and said high voltage secondary winding having a step-up voltage relationship with said primary winding, and said transformer primary having a predetermined inductance characteristic;

first and second transistor means, each of said transistor means having an emitter, collector and base;

capacitor means connected across said primary winding and defining therewith a parallel resonant circuit;

means connecting said feedback winding between the bases of said first and second transistor means;

inductor means connected in series circuit with the center tap of said primary winding, said inductor means having an inductance level characteristic of said primary winding, and said transformer core containing an air gap to render said core nonstaurating;

said emitters of said transistor means being connected in common and said collectors of said transistor means being connected to respective alternate ends of said primary winding; source means for applying DC voltage and current to said inductor means, and first means, including resistor means, connected between said source means and the base of one of said transistor means for applying a limited DC current from said source means to said bases of said transistor means, whereby each said transistor means alternately conducts current through a primary winding half in a self-oscillating mode at a frequency determined in part by said resonant circuit and sinusoidal AC voltage is generated across said high voltage secondary winding;

and means coupling each said lamp across said high voltage secondary winding;

the improvement which comprises in combination therewith: circuit means responsive to the presence of DC voltage applied to said inductor means over a first interval of time for gradually increasing the current supplied to said bases of said transistors from a first current level to a second greater current level during a second interval of time subsequent to the lapse of said first interval of time, whereby the AC voltage across said secondary winding is of a first AC voltage level below the starting voltage of said lamps for a first predetermined interval and thereafter increases to a second greater AC level, at least as great as the starting voltage of said lamps in said electrical load to start said lamps in sequence.

7. The invention as defined in claim 6 wherein each of said transistors have a storage characteristic of between 1.7 and 10 microseconds with said storage characteristic being variable in proportion to base drive current.

8. The invention as defined in claim 6 wherein said circuit means includes means responsive to a reduction in source means voltage for providing a corresponding reduction in base drive current of said first and second transistor means to reduce the storage time of said transistors, whereby the frequency of said self-oscillating mode is increased, and the resulting decrease in lamp circuit is proportionately less than the decrease in DC voltage.

9. The invention as defined in claim 6 wherein said circuit means comprises:

a timing network having an output;

transistor switching means;

breakdown diode means connected between said timing network means and said transistor switch means;

said transistor switching means containing an emitter to collector circuit for connection in series with a DC current conducting circuit comprising a second source of DC; said transistor and resistance means coupled in circuit to the base of at least one of said transistors, said breakdown diode means for providing a control current to said transistor means being responsive to the voltage output of said timing network attaining a predetermined level and thereafter providing proportionately larger control current in dependence upon the voltage output of said timing network in excess of said predetermined voltage level;

whereby said transistor switching means provides increased base drive current subsequent to said operation of said circuit means up to a maximum current level at the saturation current level of said transistor switch means.

10. The invention as defined in claim 9 wherein said second DC source comprises:

a supplementary low voltage winding on said transformer core;

a rectifier and filter capacitor means for deriving a DC voltage proportional to the AC voltage developed across said supplementary winding.

11. An inverter-oscillator of the type for supplying AC voltage and current for starting and operating an electrical load, said load containing a capacitor and a gaseous discharge lamp of the type having a high starting voltage and a lower operating voltage connected in electrical series circuit, whereby current through said electrical load is dependent upon the applied AC voltage and the frequency of such applied voltage, said inverter-oscillator including:

transformer means having a primary winding and at least a first secondary output winding with said first secondary connected across said electrical load and transistor means coupled to said primary winding for applying current through said primary winding and arranged in a self-oscillatory circuit with said transformer means for generating AC voltage output across said secondary winding; and wherein said transformer output voltage is proportional to said current through said primary winding; power supply means for supplying DC voltage and current to said transistor means; said transistor means including at least one control element, and responsive to the level of current introduced to said control element for controlling the level of current passed by said transistor means up to a maximum saturation current level, said transistor means further containing a storage time characteristic which is variable in proportion to level of current into said control element;

control means responsive to the application of DC voltage of said power supply means for providing a first limited current to said control terminal of said transistor means for a first time interval and thereafter increasing said current level into said control terminal over a further interval to a second current level, whereby said transistor means is enabled to conduct current at its saturation current level and the voltage applied to said electrical load is increased from a first lower level gradually to a second higher level sufficient to start said lamp in said electrical load.

12. The invention as defined in claim 11 wherein said self-oscillatory circuit includes frequency determining means and said frequency determining means is dependent in part on said storage time characteristic of said transistor means; and wherein said control means is further responsive to a decrease in level of said DC voltage of said power supply means for correspondingly proportionately reducing said current level into said control terminal of said transistor means to cause a decrease in said storage time of said transistor means and an increase in the frequency of oscillation of said oscillator means, whereby as the AC voltage applied across said load reduces indirectly due to a decrease in DC voltage of said power supply means and the frequency of said AC voltage increases so that a change in AC output voltage is greater in percentage than the change in load current.

13. The invention as defined in claim 11 wherein said control means comprises:

timing circuit means, said timing circuit means for producing an output current responsive to the presence of said DC voltage over a predetermined interval and thereafter producing gradually increasing current levels;

second transistor switching means, said second transistor switching means having a control input and an output circuit adapted to be placed into the current conducting condition with a certain minimum input drive current and adapted to pass a larger current in proportion to the input current up to a maximum saturation current;

bias source means and means connecting said bias source means and said second transistor switching means in series circuit to the control element of said transistor means, and means coupling the control input of said second transistor switching means to the output of said timing circuit means.

14. The invention as defined in claim 13 wherein said bias source means comprises: a supplemental secondary winding on said transformer means, and DC rectifier and filter capacitor means connected to said supplemental winding for supplying DC voltage.

15. The invention as defined in claim 14 wherein said combination further includes at least first and second heater windings on said transformer means, and said lamp contains first and second heaters, and including means connecting respective ones of said heater windings in circuit with said first and second heaters.

16. The invention as defined in claim 15 wherein said second transistor means comprises first and second transistors arranged in a Darlington circuit.

17. The invention as defined in claim 11 wherein said power supply means includes: AC to DC bridge rectifier means adapted to be connected at an input to an AC voltage source; filter means coupled to said rectifier means for supplying a partially filtered DC voltage.

18. The invention as defined in claim 11 wherein said transistor means comprises a first and second transistor coupled in circuit with alternate halves of said primary winding and arranged to pass current through said primary winding in opposite directions and feedback winding means on said means transformer connected across the base of each of said first and second transistors.

19. The invention as defined in claim 12 wherein said storage time characteristic of said transistor means is greater than one-tenth (1/10th) the quantity 1/(2f), where f is a frequency of self-oscillation of said self-oscillatory circuit during lamp operation.

20. The invention as defined in claim 17 wherein said AC to DC rectifier means includes first and second inductor means, said first inductor means having an inductance value at least as great as said second inductor means for preventing RF energy from passing to said AC voltage source and for partially filtering the rectified AC.

21. The invention as defined in claim 13 wherein said timing circuit means comprises resistor means, capacitor means, said resistor means and capacitor means connected in electrical series circuit across said output of said DC power supply means; breakdown diode means, said breakdown diode means being connected in series circuit between the juncture of said resistor and capacitor means and the control electrode of said second transistor means.

* * * * *